US007162985B2

(12) United States Patent
Itoh et al.

(10) Patent No.: US 7,162,985 B2
(45) Date of Patent: Jan. 16, 2007

(54) TWO-CYLINDER V-TYPE OHV ENGINE FOR OUTBOARD MOTORS

(75) Inventors: Jun Itoh, Hamamatsu (JP); Shigeo Unno, Hamamatsu (JP); Hiroyuki Maejima, Hamamatsu (JP); Yasushi Miyashita, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 11/157,541

(22) Filed: Jun. 21, 2005

(65) Prior Publication Data

US 2005/0279307 A1 Dec. 22, 2005

(30) Foreign Application Priority Data

Jun. 21, 2004 (JP) ..... 2004-182921

(51) Int. Cl.
*F01L 1/02* (2006.01)

(52) U.S. Cl. ..... 123/90.31; 123/90.27; 123/54.4; 123/198 C; 440/88 P; 440/88 L

(58) Field of Classification Search ..... 123/90.31
See application file for complete search history.

(56) References Cited

U.S. PATENT DOCUMENTS 4,058,092 A * 11/1977 Hikosaka et al. ..... 123/275
4,957,078 A * 9/1990 Ohkawa et al. ..... 123/90.31
5,553,586 A * 9/1996 Koishikawa et al. ..... 123/195 P
5,992,393 A * 11/1999 Yoshida et al. ..... 123/509
6,789,521 B1 * 9/2004 Ashida et al. ..... 123/182.1

FOREIGN PATENT DOCUMENTS

JP 7-293268 11/1995

* cited by examiner

*Primary Examiner*—Thomas Denion
*Assistant Examiner*—Kyle M. Riddle
(74) *Attorney, Agent, or Firm*—Cohen, Pontani, Lieberman & Pavane

(57) ABSTRACT

A two-cylinder V-type OHV engine for outboard motors, which allows space saving in the direction of the width of the engine. A starboard side cylinder bank (RB) has a cylinder (34R) and a port side cylinder bank (LB) has a cylinder (34L). The first cylinder bank (RB) and the second cylinder bank (LB) are arranged to form a V-shape. A crankshaft (35), a single camshaft (44), and an idle gear (44) are disposed such that the crankshaft (35) drives the single camshaft (41) via the idle gear (44).

6 Claims, 13 Drawing Sheets

FRONT
LEFT
3
112
35
42
44
161
162
126
43
121
119
45
41
113
110L
111L
110R
111R

FRONT
LEFT
3
112
127
124
117
122
123
116
126a
126
118
115
120
125
114
114a
113
110L
111L
110R
111R

TWO-CYLINDER V-TYPE OHV ENGINE FOR OUTBOARD MOTORS

BACKGROUND OF THE INVENTION

1. Field of the Invention

The present invention relates to a two-cylinder V-type OHV engine for outboard motors.

2. Description of the Related Art

Conventionally, there has been proposed a V-type OHV engine e.g. in Japanese Laid-Open Patent Publication (Kokai) No. H07-293268, in which a timing gear formed coaxially and integrally with a camshaft and a crank gear disposed coaxially with a crankshaft are meshed with each other such that torque from the crankshaft is transmitted to the camshaft via the timing gear and the crank gear, whereby the camshaft is substantially directly driven by the crankshaft.

However, in the V-type OHV engine proposed in Japanese Laid-Open Patent Publication (Kokai) No. H07-293268, both the timing gear and the crank gear tend to be large in size due to the need for meshing of the two gears, which causes not only an increase in the size of the engine, but also an increase in the weight of the camshaft itself. This is disadvantageous particularly when the V-type OHV engine is installed in an outboard motor which strongly requires downsizing. In view of the problem, it is essential to provide measures for minimizing an increase in the width of the engine.

SUMMARY OF THE INVENTION

It is an object of the present invention to provide a two-cylinder V-type OHV engine for outboard motors, which allows space saving in the direction of the width of the engine.

To attain the above object, the present invention provides a two-cylinder V-type OHV engine (2) for an outboard motor, comprising a first cylinder bank (RB) having a first cylinder (34R), a second cylinder bank (LB) having a second cylinder (34L), a single camshaft (41), an idle gear (44), and a crankshaft (35), wherein the first cylinder bank (RB) and the second cylinder bank (LB) are arranged to form a V-shape, and the crankshaft (35), the single camshaft (44), and the idle gear (44) are disposed such that the crankshaft (35) drives the single camshaft (41) via the idle gear (44).

According to the present invention, it is possible to achieve space saving in the direction of the width of the engine.

Preferably, the engine is vertically installed, the first and second cylinders are provided on respective right and left sides of the engine and vertically offset from each other such that one of the first and second cylinders is disposed at a higher location than the other, and the idle gear is offset toward one of the right and left sides of the engine where the one (34R) of the first and second cylinders, which is disposed at the higher location, is provided.

Preferably, the engine is vertically installed, the first and second cylinders are vertically offset from each other, and the camshaft has an intake cam (41*a*) for the first cylinder, an intake cam (41*b*) for the second cylinder, an exhaust cam (41*c*) for the first cylinder, an exhaust cam (41*d*) for the second cylinder, and a fuel pump-driving cam (41*i*) sequentially formed in an order mentioned along an axis thereof.

Preferably, the two-cylinder V-type OHV engine comprises a fuel pump (78) disposed between the first and second cylinder banks together with the camshaft, such that the fuel pump is driven by the camshaft.

Preferably, the camshaft has an oil passage (41*e*) formed therein along an axis thereof, the engine comprises a hollow member (150) inserted in the oil passage, the hollow member having a hollow part (150*b*) and forming a part of a decompression mechanism, and lubricating oil is introduced into the hollow part of the hollow member and the oil passage of the camshaft.

The above and other objects, features, and advantages of the invention will become more apparent from the following detailed description taken in conjunction with the accompanying drawings.

BRIEF DESCRIPTION OF THE DRAWINGS

FIGS. 7A to 7D are bottom views schematically showing the structure of the oil pan in FIG. 1, wherein FIG. 7A is a bottom view of the oil pan;

FIG. 7B is a left side view of the oil pan;

FIG. 7C is a top plan view of the oil pan; and

FIG. 7D is a right side view of the oil pan;

DETAILED DESCRIPTION OF THE PREFERRED EMBODIMENTS

The present invention will now be described in detail with reference to the accompanying drawings showing a preferred embodiment thereof.

Figure 1:
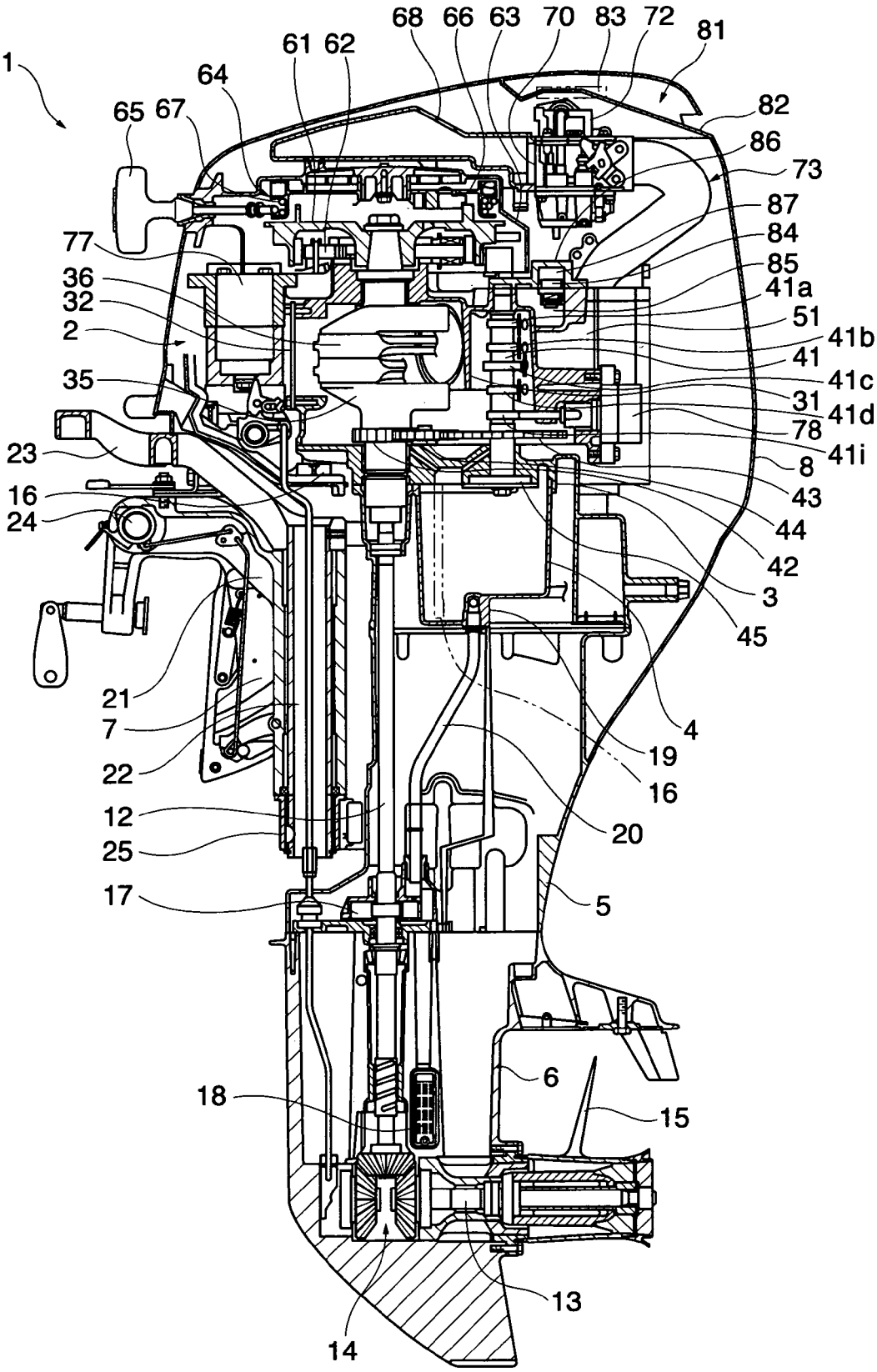
FIG. 1 is a longitudinal cross-sectional view of an outboard motor equipped with a two-cylinder V-type OHV engine according to an embodiment of the present invention.
Figure 2:
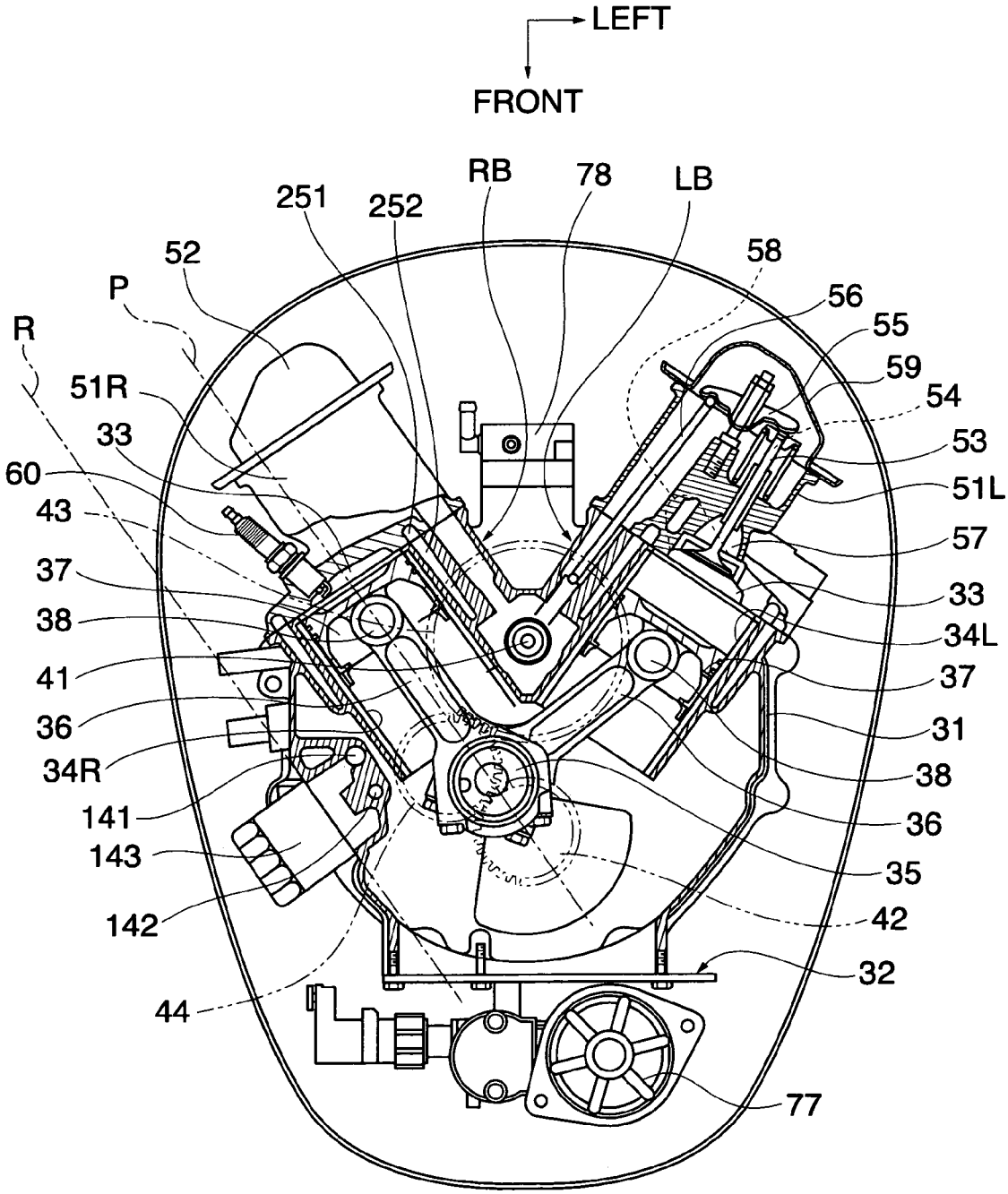
FIG. 2 is a transverse cross-sectional view of the outboard motor in FIG. 1.

FIG. 1 is a longitudinal cross-sectional view of an outboard motor equipped with a two-cylinder V-type OHV engine according to an embodiment of the present invention. FIG. 2 is a transverse cross-sectional view of the outboard motor.

Hereafter, the left side (i.e. the hull side), as viewed in FIG. 1, of the outboard motor 1 will be referred to as "the front", the right side thereof as "the rear", the upper side as "the top", the lower side as "the bottom", the side toward the viewer as "the port side", and the side remote from the viewer as "the starboard side".

As shown in FIG. 1, the outboard motor 1 is comprised of an engine 2, an oil pan 4 joined and fixed to a lower surface of the engine 2, a drive shaft housing 5 fixed to a lower part of the oil pan 4, and a gear housing 6 fixed to a lower part of the drive shaft housing 5. The engine 2 is a water-cooled four-cycle two-cylinder V-type OHV engine having a crankshaft 35 substantially perpendicularly (vertically) installed therein. The outboard motor 1 has a vertically dividable engine cover 8 that covers the engine 2 and the oil pan 4.

A drive shaft 12 substantially vertically extends through the oil pan 4 and the drive shaft housing 5. The drive shaft 12 further extends downward from the drive shaft housing 5 into the gear housing 6 to drive a propeller 15 as a propulsion device via a bevel gear 14 and a propeller shaft 13.

As will be described in detail hereinafter with reference to FIGS. 7B and 7D, the oil pan 4 has upper mount fixing parts 104L and 104R formed in respective port side and starboard side surfaces thereof. A pair of left and right upper mounts, not shown, are attached to the respective upper mount fixing parts 104L and 104R. The upper mounts are connected to an upper mount bracket 23. Further, a pair of lower mounts, not shown, are provided on respective opposite sides of the drive shaft housing 5. The lower mounts are connected to a lower mount bracket 25. In the outboard motor 1, as described hereinafter, the upper mount bracket 23 and the front end of the lower mount bracket 25 are connected to a clamp bracket 7, and the clamp bracket 7 is fixed to a stem plate of a hull, not shown.

The clamp bracket 7 has a swivel bracket 21 attached thereto via a tilt shaft 24, and a pilot shaft 22 is rotatably supported in the swivel bracket 21 in a vertical direction. The upper mount bracket 23 and the lower mount bracket 25 are attached to upper and lower ends of the pilot shaft 22, respectively, for rotation in unison with the pilot shaft 22. With this arrangement, the outboard motor 1 can be steered about the pilot shaft 22 from side to side with respect to the clamp bracket 7 and can be tilted upward about the tilt shaft 24.

A cylinder block 31 is disposed in the foremost end (i.e. on the bow side) of the engine 2, and cylinder heads 51 are disposed at the rear of the cylinder block 31. The foremost surface of the cylinder block 31 is covered by a cylinder cover 32. As shown in FIG. 2, the cylinder block 31 and the cylinder heads 51 (51L and 51R) are arranged in a V-shape to form a V-shaped cylinder bank (i.e. the port side cylinder bank LB and the starboard side cylinder bank RB).

Figure 3:
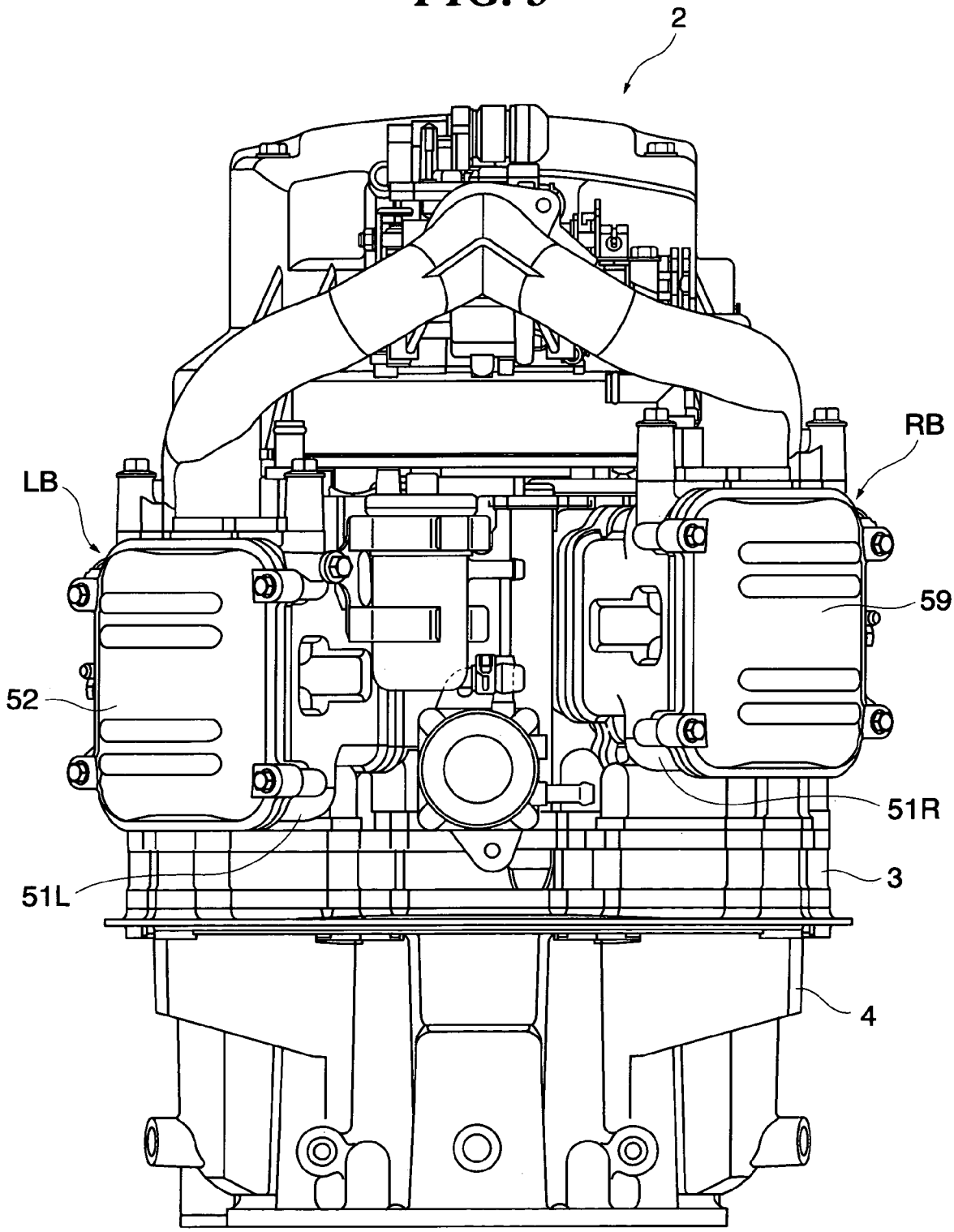
FIG. 3 is a rear view of the engine and an oil pan of the outboard motor.
Figure 8B:
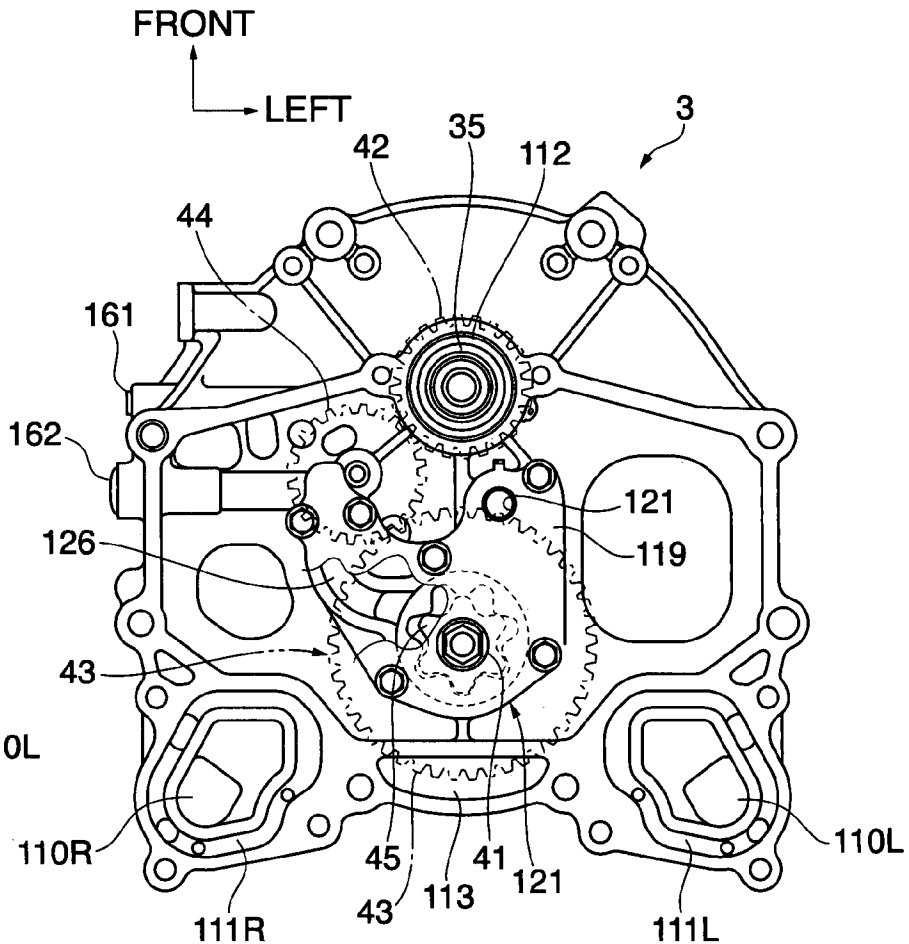
FIGS. 8A and 8B are bottom views schematically showing the structure of a crankcase, as a unitary member, of the engine in FIG. 1.
Figure 8A:
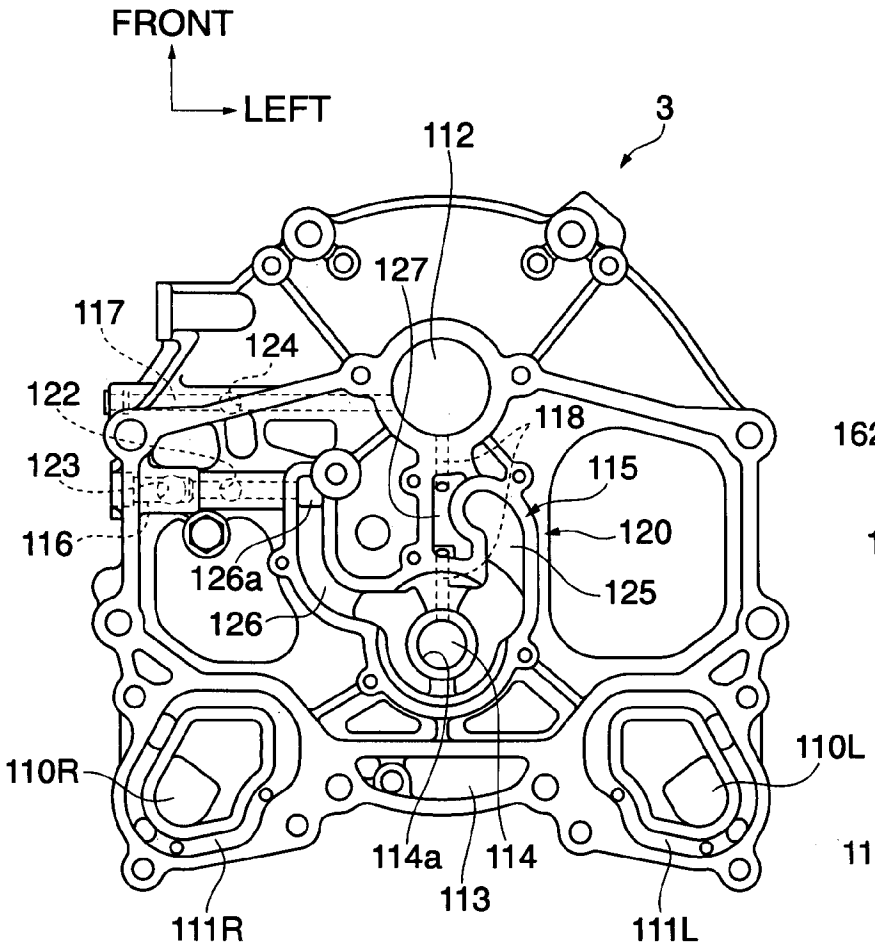

On lower surfaces of the cylinder block 31 and cylinder heads 51L and 51R, there is disposed a crankcase 3 in which the lower part of the crankshaft 35 is accommodated (see FIGS. 3, 8A, and 8B). The crankcase 3 is formed therein with a hole for oil return, and the oil pan 4 is connected to the lower part of the crankcase 3. The crankshaft 35 has an upper end thereof rotatably supported by an upper part of the cylinder block 31 and a lower end thereof rotatably supported by the crankcase 3. The crankshaft 35 is connected to the drive shaft 12.

Further, as shown in FIGS. 1 and 2, a camshaft 41 extends parallel with the crankshaft 35 between the cylinder banks LB and RB, more specifically at a location close to the front end of the V-shaped bank and rearward of the crankshaft 35 in the cylinder block 31. The camshaft 41 has an upper end thereof rotatably supported by an upper part of the cylinder block 31 and a lower end thereof rotatably supported by the crankcase 3. A crank gear 42 is fixed to the lower end of the crankshaft 35, and a cam gear 43 is fixed to the lower end of the camshaft 41. An idle gear 44 is rotatably supported by the crankcase 3. The idle gear 44 is located at substantially the same location in the vertical direction as the cam gear 43 and the crank gear 42. Further, the idle gear 44 is located at a location offset toward the starboard side in the transverse direction. The idle gear 44 is located below a cylinder 34R, described hereinafter, with a portion thereof overlapping the cylinder 34R, as viewed in plan view. The idle gear 44 is in mesh with the crank gear 42 and the cam gear 43 to transmit torque from the crankshaft 35 to the camshaft 41.

As shown in FIG. 1, on the top of the gear housing 6, there is disposed a water pump 17 which is driven by the drive shaft 12, and the gear housing 6 is formed therein with a water inlet 18 opening into the gear housing 6. The oil pan 4 is formed therein with a water reservoir 19, described hereinafter with reference to FIG. 7, to which outside water (sea water, lake water, river water, etc.) taken in as coolant by the water pump 17 via the water inlet 18 is supplied through a water tube 20. The water tube 20 is mounted in a water tube fitting hole 92 (see FIG. 7A) of the oil pan 4.

Water stored in the water reservoir 19 passes through a coolant path, not shown, to cool the cylinder block 31 and the left and right cylinder heads 51 (51L and 51R; see FIGS. 2 and 3), followed by being discharged out of the outboard motor 1 together with exhaust gasses through a center hole of the propeller 15.

In the crankcase 3, at the lower end of the camshaft 41, there is provided an oil pump 45 which is connected to an oil strainer 16 extending to an inner bottom portion of the oil pan 4. Lubricating oil (hereinafter simply referred to as "oil") stored in the oil pan 4 is pumped up by the oil pump 45 through the oil strainer 16, as described in detail hereinafter, and then supplied to related parts within the engine 2, followed by being returned to the oil pan 4.

Figure 4:
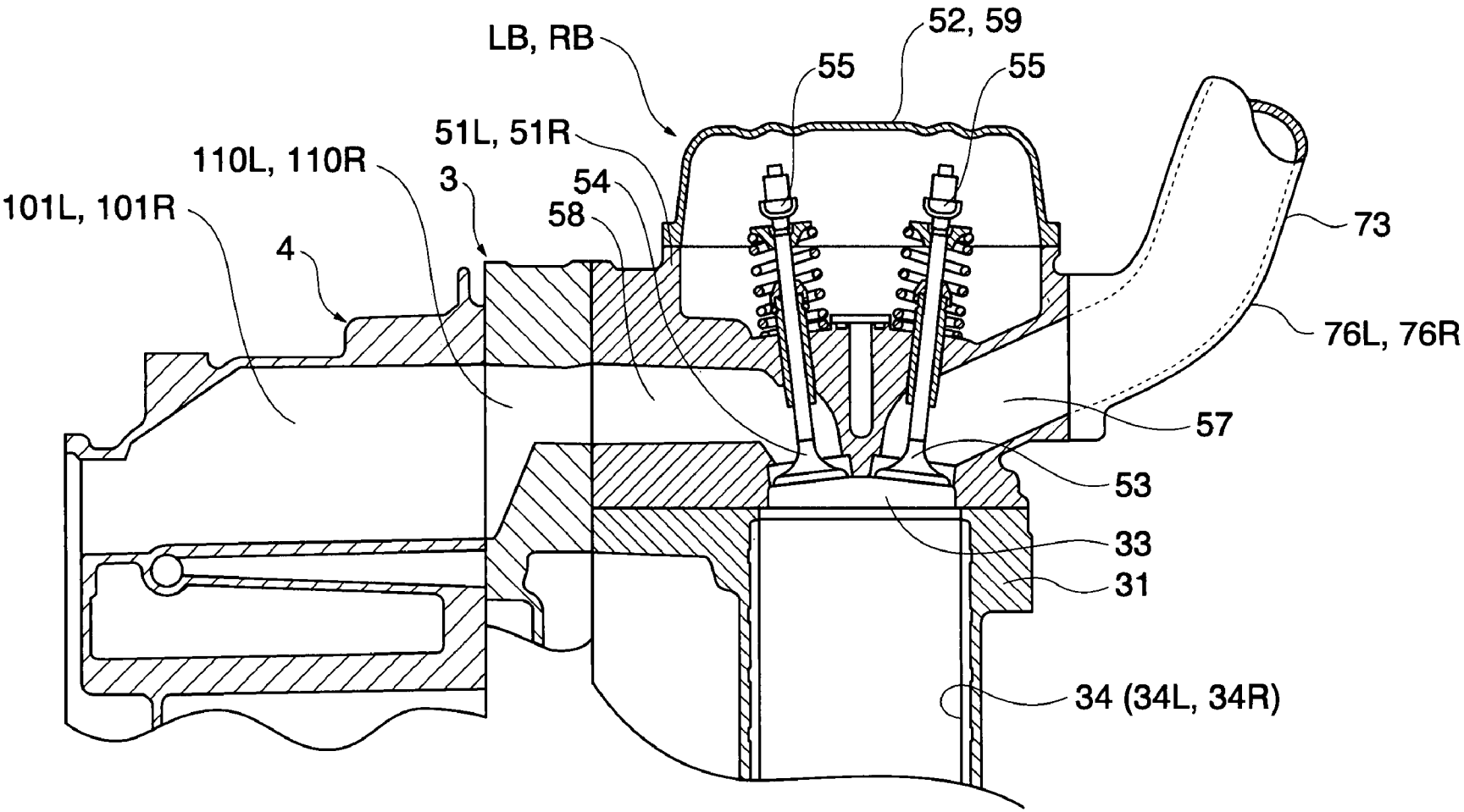
FIG. 4 is a fragmentary cross-sectional view of the outboard motor.

FIG. 3 is a rear view of the engine 2 and the oil pan 4 of the outboard motor 1, and FIG. 4 is a fragmentary cross-sectional view of the outboard motor 1.

As described hereinabove with reference to FIGS. 2 and 3, the engine 2 has the pair of left and right cylinder heads 51 (51L and 51R) arranged so as to form a V-shaped cylinder bank opening rearward as viewed in plan view. Further, as shown in FIG. 3, the cylinder head 51R is disposed parallel with the crankshaft 35 and offset upward from the cylinder head 51L. More specifically, the cylinder head 51R is disposed at a higher location than the cylinder head 51L by a predetermined offset amount in the axial direction of the crankshaft 35. It should be noted that the cylinder head 51R may be offset downward from the cylinder head 51L.

The port side cylinder bank LB and the starboard side cylinder bank RB are basically identical in structure. The cylinder block 31 has one cylinder 34 (34L or 34R) formed therein on each side (i.e. in each of the cylinder banks LB and RB). On the other hand, as shown in FIG. 4, each of the cylinder heads 51 has formed therein a combustion chamber 33 in alignment with the cylinder 34, and an intake port 57 and an exhaust port 58 communicating with the combustion chamber 33. The intake port 57 and the exhaust port 58 are disposed above and below the combustion chamber 33, respectively, such that the intake port 57 opens in an upper surface of the cylinder head 51, and the exhaust port 58 opens in a lower surface of the same. At a location between the intake port 57 and the exhaust port 58, a spark plug 60 is mounted for each of the combustion chambers 33, for ignition of a compressed air-fuel mixture within the combustion chamber 33. The cylinder heads 51L and 51R are covered by respective head covers 52 and 59.

An intake valve 53 and an exhaust valve 54 are provided in each of the cylinder heads 51L and 51R, as shown in FIG. 4, such that the intake valve 53 can open and close the intake port 57 and the exhaust valve 54 can open and close the exhaust port 58. As shown in FIG. 2, inside the head cover 59, a locker arm 55 is swingably supported in linkage with each of the intake valve 53 and the exhaust valve 54. The locker arm 55 engages with a pushrod 56 at an end thereof corresponding to an inner side of the cylinder bank, and comes into contact with the intake valve 53 or the exhaust valve 54 at an end thereof corresponding to an outer side of the cylinder bank (see FIG. 2).

As shown in FIG. 1, the camshaft 41 is formed with an RI cam 41*a* for axially moving the intake valve 53 of the cylinder head 51R, an LI cam 41*b* for axially moving the intake valve 53 of the cylinder head 51L, an RE cam 41*c* for axially moving the exhaust valve 54 of the cylinder head 51R, an LE cam 41*d* for axially moving the exhaust valve 54 of the cylinder head 51L, and a fuel pump-driving cam 41*i* for driving a fuel pump 78, described hereinafter, which are arranged in the mentioned order from above (see FIG. 9 as well). The fuel pump-driving cam 41*i* is located above the cam gear 43.

The cams 41*a*, 41*b*, 41*c*, and 41*d* are held in contact with the respective pushrods 56. As the camshaft 41 rotates, the pushrods 56 are moved in the longitudinal direction thereof along the profiles of the respective associated cams, whereby the locker arms 55 swing to move the intake valve 53 of the cylinder head 51R, the intake valve 53 of the cylinder head 51L, the exhaust valve 54 of the cylinder head 51R, and the exhaust valve 54 of the cylinder head 51L, respectively. Thus, in each of the cylinder heads, communication of the intake port 57 and the exhaust port 58 with the combustion chamber 33 is controlled by opening and closing of the intake port 57 and the exhaust port 58 by the intake valve 53 and the exhaust valve 54, respectively.

The camshaft 41 has the cams 41*a*, 41*b*, 41*c*, and 41*d* arranged in the mentioned order as described above, so that the offset amount of the cylinder head 51R from the cylinder head 51L can be reduced. More specifically, the positions of the RI cam 41*a* and the RE cam 41*c*, i.e. the intake and exhaust cams for the upper cylinder 34R, overlap the positions of the LI cam 41*b* and the LE cam 41*d*, i.e. the intake and exhaust cams for the lower cylinder 34L, respectively, so that even if the offset amount between the upper cylinder 34R and the lower cylinder 34L is smaller than in a case where the cams are arranged in the order of 41*a*, 41*c*, 41*b*, and 41*d*, it is possible to set each cam position properly, thereby saving space in the engine 2 in the vertical direction.

Figure 5:
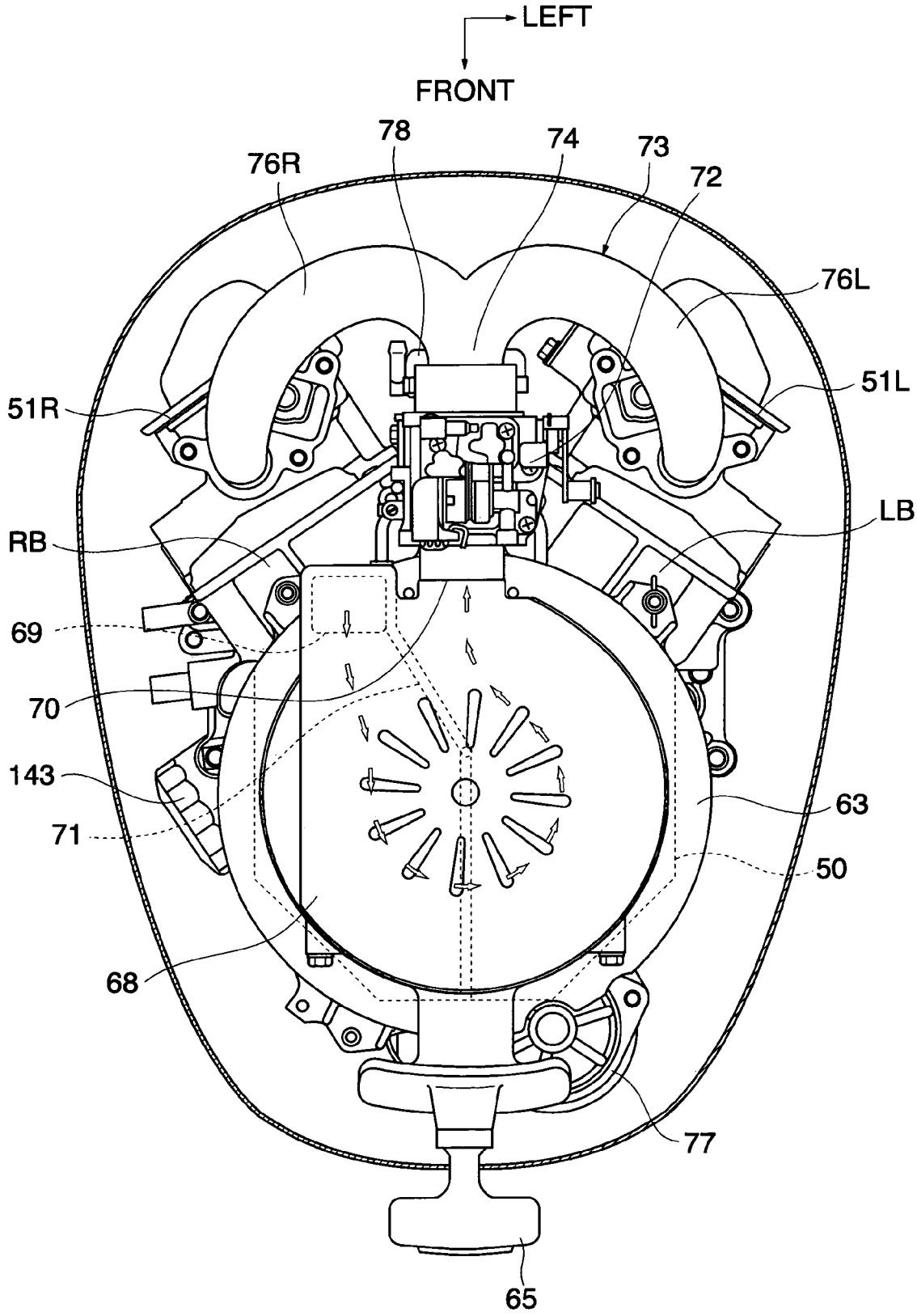
FIG. 5 is a top plan view schematically showing the arrangement of the outboard motor.
Figure 6:
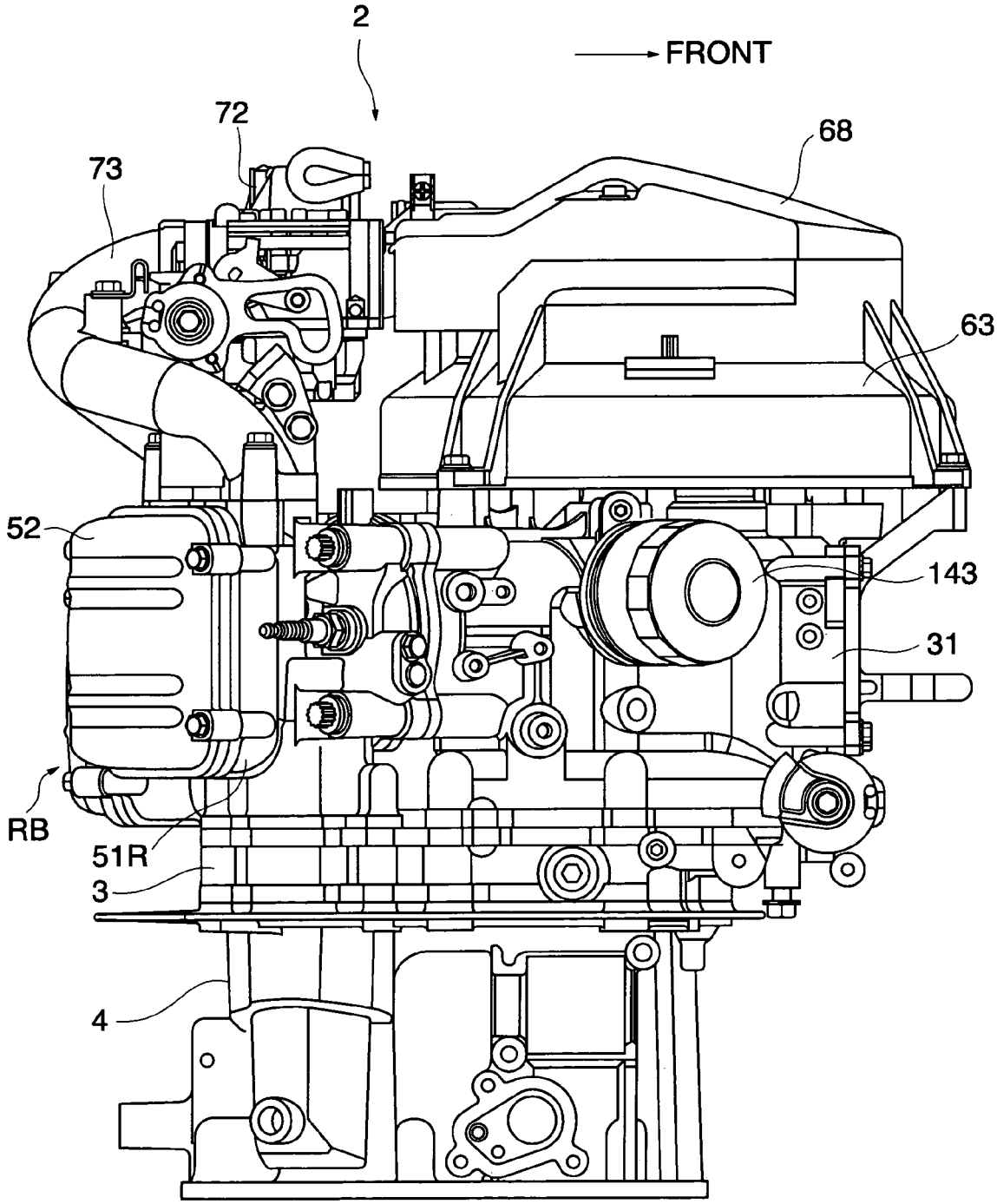
FIG. 6 is a side view of the engine and the oil pan in FIG. 1, as viewed from a starboard side.

FIG. 5 is a top plan view schematically showing the arrangement of the outboard motor 1, and FIG. 6 is a side view of the engine 2 and the oil pan 4, as viewed from the starboard side.

As shown in FIG. 1, a flywheel magnet 61 is fixedly fitted on the upper end of the crankshaft 35, and in an upper part of the cylinder block 31, a battery charge coil 62 is fixedly wound around the crankshaft 35 inside the flywheel magnet 61. Further, as shown in FIGS. 1 and 5, on the upper part of the cylinder block 31, there is mounted a flywheel magnet cover 63 containing the flywheel magnet 61.

As shown in FIG. 1, the flywheel magnet cover 63 has a recoil starter 64 mounted therein at a location above the flywheel magnet 61. The recoil starter 64 is comprised of a starter grip 65, a reel 66 rotatably supported by the flywheel magnet cover 63, a spring 67 wound around a groove in the reel 66, with one end thereof connected to the starter grip 65 and the other end to a shaft of the reel 66, and an engaging part, not shown, which engages with the flywheel magnet 61 when the spring 67 is pulled. In the recoil starter 64, when the starter grip 65 is pulled, the spring 67 is pulled to rotate the reel 66, and at the same time the engaging part, not shown, is brought into engagement with the flywheel magnet 61 to cause rotation of the flywheel magnet 61, whereby the crankshaft 35 is rotated to start the engine 2. A starter motor 77 is disposed on the port side forward of the cylinder block 31.

In the outboard motor 1, there is disposed an intake silencer 68 at a location above the flywheel magnet cover 63. The intake silencer 68 has an inlet port 69 which opens downward and rearward in the starboard side of the engine 2, a communication port 70 which opens rearward, and a partition plate 71 partitioning an inner space thereof. Outside air drawn through the inlet port 69 flows in the intake silencer 68 along the partition plate 71 in directions indicated by arrows in FIG. 5 to be discharged from the communication port 70.

At a location rearward of the intake silencer 68 and above a space between the cylinder banks LB and RB of the cylinder block 31, there is disposed a carburetor 72 that communicates with the intake silencer 68 via the communication port 70. Further, an intake manifold 73 is disposed at the rear of the carburetor 72. The intake manifold 73 is comprised of a communication pipe 74, and a port side intake pipe 76L and a starboard side intake pipe 76R which branch off from one end of the communication pipe 74. The communication pipe 74 has the other end thereof connected to the carburetor 72 for communication between the carburetor 72 and the intake manifold 73. The intake pipe 76L is connected to the cylinder head 51L for communication between the intake manifold 73 and the intake port 57 of the cylinder head 51L, while the intake pipe 76R is connected to the cylinder head 51R for communication between the intake manifold 73 and the intake port 57 of the cylinder head 51R (see FIG. 4).

The carburetor 72 mixes outside air drawn from the intake silencer 68 with fuel supplied via the fuel pump 78 disposed between the cylinder banks LB and RB, to form an air-fuel mixture. The air-fuel mixture is drawn into the respective cylinders 34L and 34R of the cylinder banks LB and RB via the intake manifold 73.

As shown in FIG. 1, the engine cover 8 has an outside air inlet chamber 81 formed in an upper rear part thereof, an outside air inlet port 82 formed in an upper rear part thereof and generally in the transverse center thereof, and communicating between the outside air inlet chamber 81 and the outside of the engine cover 8 to draw outside air into the outside air inlet chamber 81, and an outside air introducing duct 83 and communicating between the outside air inlet chamber 81 and the inside of the engine cover 8 so as to supply outside air to the engine 2. The outside air introducing duct 83 is disposed on the opposite side of the carburetor 72 from the inlet port 69 of the intake silencer 68 in the transverse direction of the outboard motor 1. Outside air outside the engine cover 8 is introduced into the engine cover 8 via the outside air inlet port 82, the outside air inlet chamber 81, and the outside air introducing duct 83.

Figure 7B:
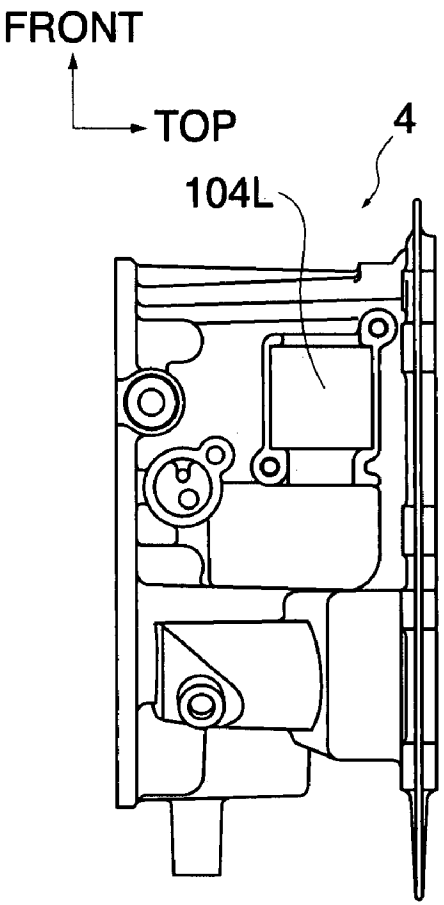
Figure 7A:
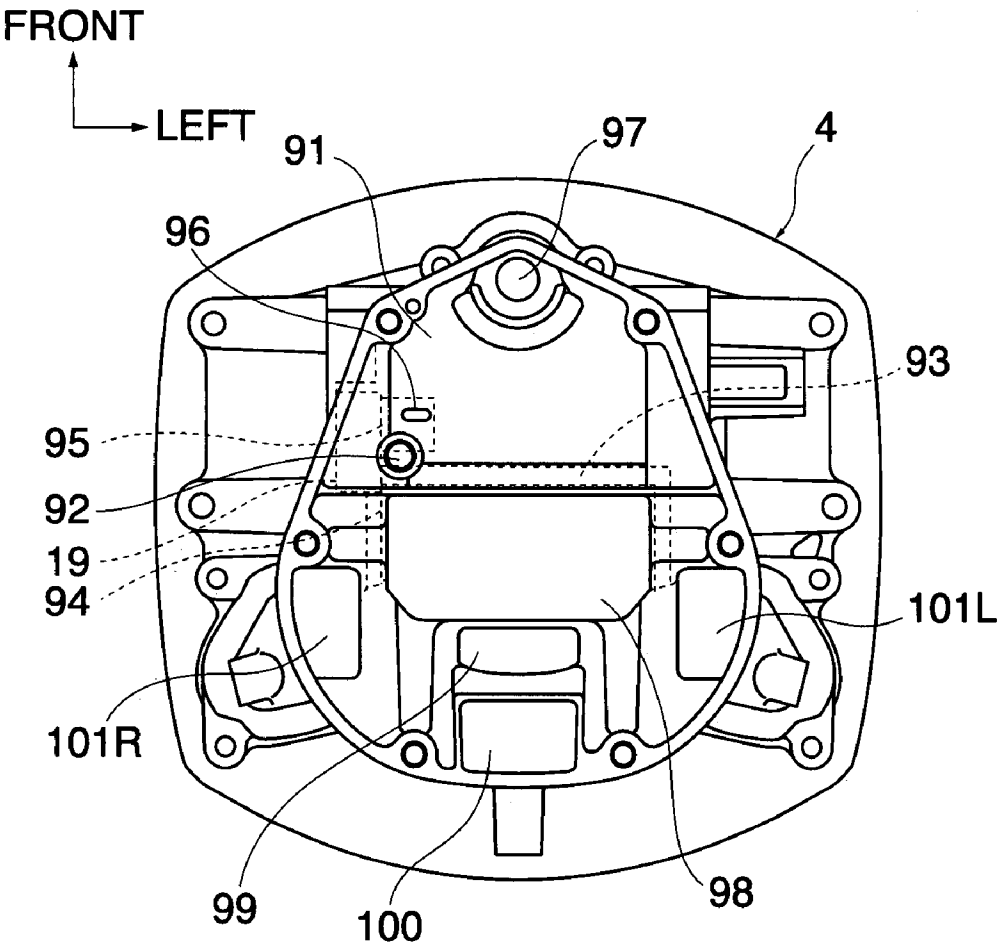
Figure 7D:
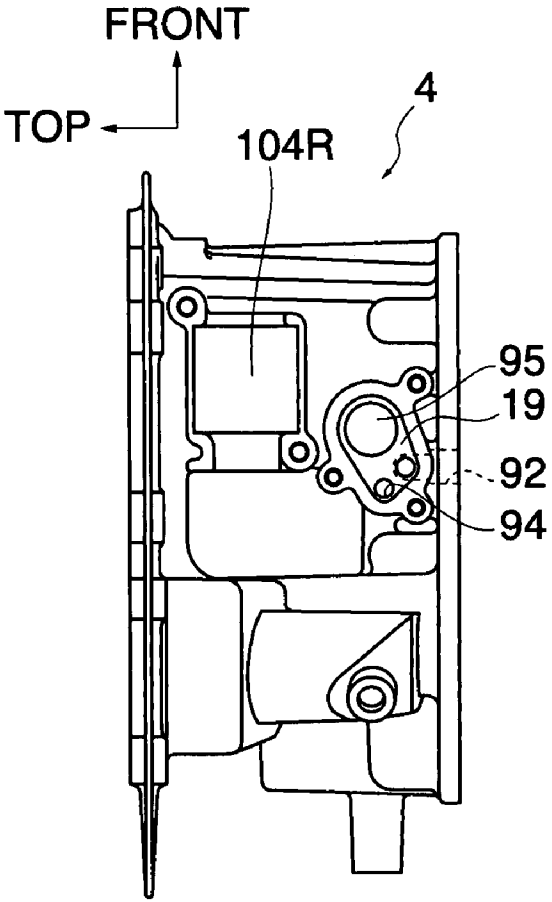
Figure 7C:
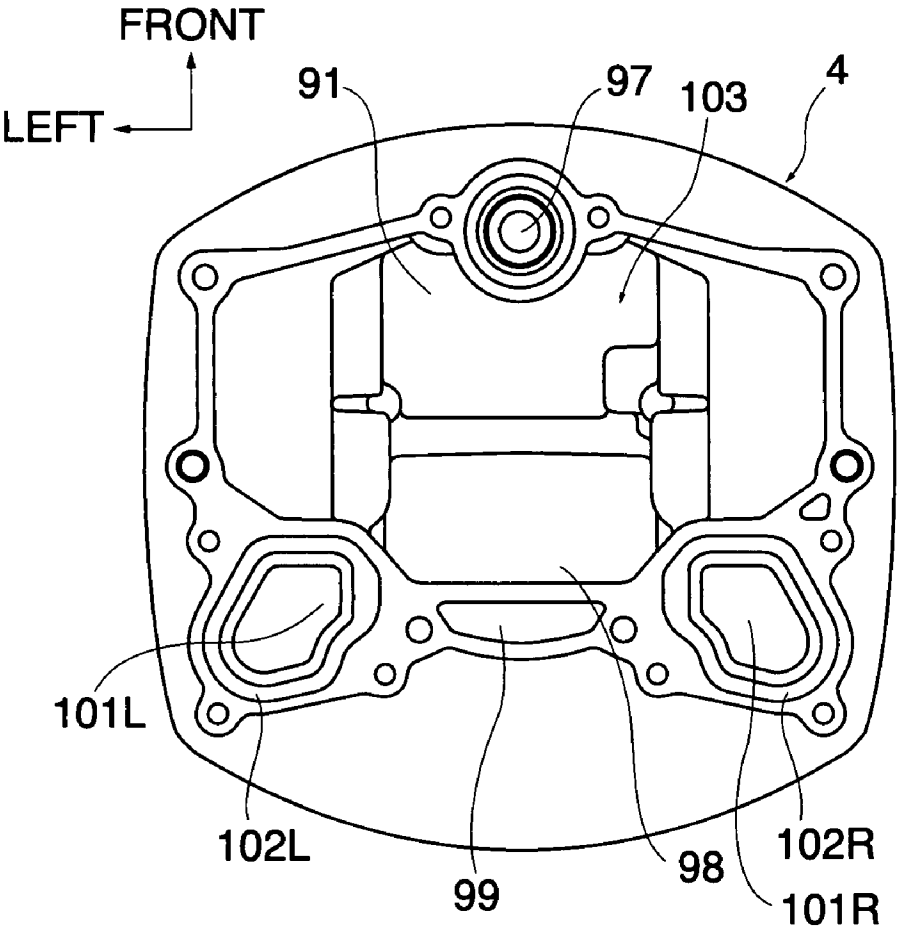

FIGS. 7A to 7D are views schematically showing the structure of the oil pan 4. FIG. 7A is a bottom view of the same; FIG. 7B is a left side view of the same; FIG. 7C is a top plan view of the same; and FIG. 7D is a right side view of the same.

As shown in FIG. 7A, the oil pan 4 has a bottom surface 91 thereof formed therein with a water tube fitting hole 92 in which the water tube 20 is fitted. The water tube fitting hole 92 is in communication with the water reservoir 19 formed in the right side of the oil pan 4. A coolant passage 93 extending in the transverse direction of the outboard motor 1 parallel with the bottom surface 91 and a coolant passage 94 extending in the longitudinal direction of the outboard motor 1 parallel with the bottom surface 91 are in communication with the water reservoir 19. Further, in the right side of the oil pan 4, a pressure valve chamber 95 accommodating a pressure valve, not shown, is formed in communication with the water reservoir 19, and the pressure valve chamber 95 is in communication with a coolant discharge hole 96 formed in the bottom surface 91. Also, the bottom surface 91 is formed therein with a drive shaft hole 97 vertically extending through the oil pan 4 and through which the drive shaft 12 is slidably and coaxially inserted in the engine 2.

At the rear of the bottom surface 91, the oil pan 4 is formed with a middle step plate-like part 98 at a location higher than and parallel with the bottom surface 91. Further, at the rear of the middle step plate-like part 98, the oil pan 4 is formed therein with a coolant return passage 99 extending vertically through the oil pan 4 and through which coolant circulated within the engine 2 is discharged out of the engine 2. Further, the oil pan 4 is formed therein with an exhaust release chamber 100 at the rear of the coolant return passage 99. A pair of exhaust passages 101L and 101R vertically extending through the oil pan 4 are formed in the rear of the oil pan 4 on respective left and right sides of the coolant return passage 99 (see FIG. 4).

As shown in FIG. 7C, the coolant passages 102L and 102R are formed in the respective left and right side parts of the oil pan 4 in the rear thereof in a manner containing the exhaust passages 101L and 101R, respectively. The coolant passages 102L and 102R are in communication with the coolant passages 94 and 93, respectively.

The oil pan 4 has an oil reservoir 103 defined therein by left and right side surfaces thereof, front and rear side surfaces thereof, the bottom surface 91 thereof, and the middle step plate-like part 98, and stores oil. The oil stored in the oil reservoir 103 is pumped by the oil pump 45 through the oil strainer 16 to be circulated within the engine 2 for lubrication of the engine 2.

As shown in FIGS. 7B and 7D, the upper mount fixing parts 104L and 104R are formed in the respective left and right sides of the oil pan 4. In the outboard motor 1, the pair of left and right upper mounts, not shown, are mounted on the respective upper mount fixing parts 104L and 104R, as described hereinabove. The upper mounts are connected to the upper mount bracket 23.

FIGS. 8A and 8B are bottom views schematically showing the structure of the crankcase 3 as a unitary member. FIG. 8B also shows the crankcase 3 together with an oil passage cover 119, described hereinafter.

As shown in FIGS. 8A and 8B, in respective left and right side parts of the crankcase 3 at the rear thereof, there are formed exhaust passages 110L and 110R extending vertically through the crankcase 3, and coolant passages 111L and 111R extending vertically through the crankcase 3 in a manner containing the exhaust passages 110L and 110R, respectively. As shown in FIG. 4, in the engine 2, a lower part of the exhaust passage 110L (110R) is in communication with the exhaust passage 101L (101R) of the oil pan 4, while an upper part of the exhaust passage 110L (110R) is in communication with the exhaust port 58 of the cylinder head 51L (51R). On the other hand, a lower part of the coolant passage 111L (111R) is in communication with the coolant passage 102L (102R) of the oil pan 4, and an upper part of the coolant passage 111L (111R) is in communication with a cylinder head coolant passage 251 (see FIG. 2) formed in the cylinder head 51L (51R).

The cylinder head coolant passage 251 is in communication with a cylinder block coolant passage 252 formed within the cylinder block 31 (see FIG. 2), and has an upper part thereof connected to a thermostat upstream chamber 85 (see FIGS. 1 and 11) formed at a location upstream of a thermostat 84 disposed between the cylinder banks LB and RB and above the cylinder block 31. The cylinder block coolant passage 252 is formed such that coolant flows into the thermostat upstream chamber 85 after having cooled the cylinder 34L (34R) of the cylinder bank LB (RB) (see FIGS. 1 and 11).

Formed in the center of the front part of the crankcase 3 is formed a crankshaft hole 112 vertically extending through the crankcase 3 and through which the crankshaft 35 of the engine 2 is coaxially and slidably inserted (see FIG. 8B), and formed in the center of the rear part of the crankcase 3 is formed a coolant return passage 113 vertically extending through the crankcase 3. In the engine 2, a lower part of the coolant return passage 113 is in communication with the coolant return passage 99 of the oil pan 4, while an upper part of the coolant return passage 113 is in communication with a coolant return pipe, not shown, attached to the cylinder block 31 between the cylinder banks LB and RB. The coolant return pipe is connected to a thermostat downstream chamber 87 (see FIGS. 1 and 11) defined at a location downstream of the thermostat 84 by a thermostat cover 86 covering the thermostat 84 and the thermostat upstream chamber 85.

Further, in the central part of the crankcase 3, there is formed an oil pump chamber 114 (see FIG. 8A) accommodating the oil pump 45 (see FIG. 8B). The oil pump chamber 114 is formed with a camshaft hole 114*a* vertically extending through the crankcase 3 and through which the camshaft 41 is coaxially and slidably inserted.

The crankcase 3 has a lubricating structure 120. The lubricating structure 120 is comprised of a curved oil passage 115 curved in a generally U-shape in plan view as viewed from the lower surface side of the crankcase 3, the oil pump 45, a straight oil passage 116 extending straight, a first in-crankcase oil passage 117, a second in-crankcase oil passage 118, and an oil passage cover 119 sealing the curved oil passage 115. The oil passage cover 119 is formed therein with an oil strainer mounting hole 121 at a location corresponding to the upper end of the oil strainer 16 in the engine 2, in which the upper end of the oil strainer 16 is air-tightly press-fit. The lubricating structure 120 supplies various parts of the engine 2 with oil stored in the oil reservoir 103 of the oil pan 4, as the oil pump 45 operates.

Further, the crankcase 3 is formed therein with an oil filter communication hole 122, an oil pan communication hole 123, and a main gallery communication hole 124 each extending in the vertical direction of the crankcase 3 (see FIG. 8A). The oil filter communication hole 122 has an upper end thereof opening in the upper surface of the crankcase 3, and in the engine 2, communicates with an oil filter passage 141 (FIG. 2) extending in the cylinder block 31. The oil pan communication hole 123 has an upper end thereof opening in the upper surface of the crankcase 3 and communicates with the oil reservoir 103 of the oil pan 4. The main gallery communication hole 124 has an upper end thereof opening in the upper surface of the crankcase 3, and in the engine 2, communicates with a main gallery 142 (FIG. 2) extending in the cylinder block 31 parallel with the crankshaft 35. The oil filter passage 141 and the main gallery 142 are connected to each other via an oil filter 143. The oil filter 143 is mounted on the starboard side front surface of the cylinder block 31, more specifically on a plane R (FIG. 2) parallel with a plane P (FIG. 2) extending along the axis of the cylinder 34R in the cylinder bank RB and the axis of the crankshaft 35, i.e. on a plane facing forward of the outboard motor 1 (see FIG. 2).

As described above, the oil filter 143 is mounted on the front part of the engine 2 in a manner tilted forward, more specifically, in a manner tilted from the front of the engine 2 toward the starboard side, so that the user can carry out a replacement operation of the oil filter 143 or the like in the outboard motor 1 without leaving the hull, which makes it possible to facilitate replacement of the oil filter 143. The mounting position and direction of the oil filter 143 are not limited to the above-described position and direction, but the oil filter 143 may be mounted on the port side front part in a manner tilted from the front of the engine 2 toward the port side.

As shown in FIG. 8A, the curved oil passage 115 is comprised of a first oil passage 125 curved in a generally L-shape as viewed in plan view from the lower surface side of the crankcase 3 and having a generally U-shaped groove in cross section, a second oil passage 126 curved in a generally L-shape as viewed in plan view from the lower surface side of the crankcase 3 and having a generally U-shaped groove in cross section, and the oil pump chamber 114. The first oil passage 125 connects between the upper end of the oil strainer 16 and the oil pump chamber 114, and the second oil passage 126 is connected to the first oil passage 125 via the oil pump chamber 114. The curved oil passage 115 is formed by casting.

The straight oil passage 116 is a straight tunnel-like passage extending parallel with the lower surface of the crankcase 3 and perpendicularly to the axis of the crankshaft hole 112, as shown in FIG. 8A, and has one end thereof opening in the starboard side surface of the crankcase 3 and the other end opening in a front end 126*a* of the second oil passage 126. Further, the straight oil passage 116 is formed in communication with the lower end of the oil filter passage 122 and the lower end of the oil pan communication hole 123. The straight oil passage 116 is formed by machining.

As shown in FIG. 8A, the first in-crankcase oil passage 117 is a straight tunnel-like passage extending in a lower part of the crankcase 3 substantially parallel with the straight oil passage 116, and has one end thereof opening in the starboard side surface of the crankcase 3 and the other end opening into the crankshaft hole 112. Further, the first in-crankcase oil passage 117 is formed in communication with the lower end of the main gallery communication hole 124.

The second in-crankcase oil passage 118 is a straight tunnel-like passage connecting between the crankshaft hole 112 and the camshaft hole 114*a* of the oil pump chamber 114 via a recessed oil reservoir 127 formed in the lower surface of the crankcase 3 between the oil pump chamber 114 and the crankshaft hole 112.

In the crankcase 3 of the engine 2, the crankshaft 35 is inserted through the crankshaft hole 112 via a metal bearing 132, described hereinafter with reference to FIG. 12, and a starboard side open end of the first in-crankcase oil passage 117 is sealed by a plug screw 161 in the crankcase 3. Further, a relief valve 128 (see FIG. 12) is inserted in a starboard side open end of the straight oil passage 116, and the straight oil passage 116 is sealed by a plug screw 162 in the crankcase 3.

Further, in the engine 2, the camshaft 41 is inserted through the camshaft hole 114*a*, and the oil pump 45 is attached to the lower end of the camshaft 41 in the oil pump chamber 114. The oil pump 45, as well as the curved oil passage 115 and the oil reservoir 127, is sealed by the oil passage cover 119.

The curved oil passage 115 is formed by casting, and the second oil passage 126 of the curved oil passage 115 is curved in the generally L-shape, as described hereinabove, so that the front end 126*a* can be easily formed in the vicinity of the starboard side surface of the crankcase 3, the oil filter communication hole 122, and the oil pan communication hole 123. This makes it possible to reduce the length of the straight oil passage 116, thereby facilitating the machining of the straight oil passage 116. Thus, the lubricating structure 120 including the oil passages between the oil strainer 16 and the oil filter 143 can be easily formed, which makes it possible to improve the productivity of the lubricating structure 120.

Further, in the lubricating structure 120, the first and second oil passages 125 and 126 of the curved oil passage 115 are curved, and the straight oil passage 116 is short and straight, so that the necessity for taking the arrangement or the like of other structures into consideration to form the lubricating structure 120 can be reduced, or in other words, it is possible to form the lubricating structure 120 regardless of the internal construction of the engine 2. In addition, space required for machining of the lubricating structure 120 can be reduced. Therefore, the engine 2 can be downsized, which contributes to reduction of the size of the outboard motor 1.

Further, the second oil passage 126 of the curved oil passage 115, the straight oil passage 116, the first in-crankcase oil passage 117, the oil filter communication hole 122, and the oil pan communication hole 123 are formed in the starboard side portion of the crankcase 3 as described above, and the starboard side cylinder head 51R is offset upward from the cylinder head 51L and positioned at a location higher than the cylinder head 51L as described hereinabove with reference to FIG. 3, and therefore in the cylinder block 31, an empty space is formed below the cylinder head 51R. Therefore, the second oil passage 126 of the curved oil passage 115, the straight oil passage 116, the first in-crankcase oil passage 117, the oil filter communication hole 122, and the oil pan communication hole 123 are concentratedly arranged below the empty space, so that the size of the engine 2 can be reduced. Further, since the oil filter 143 is mounted on the starboard side of the cylinder block 31, the engine 2 can be further downsized.

Figure 9:
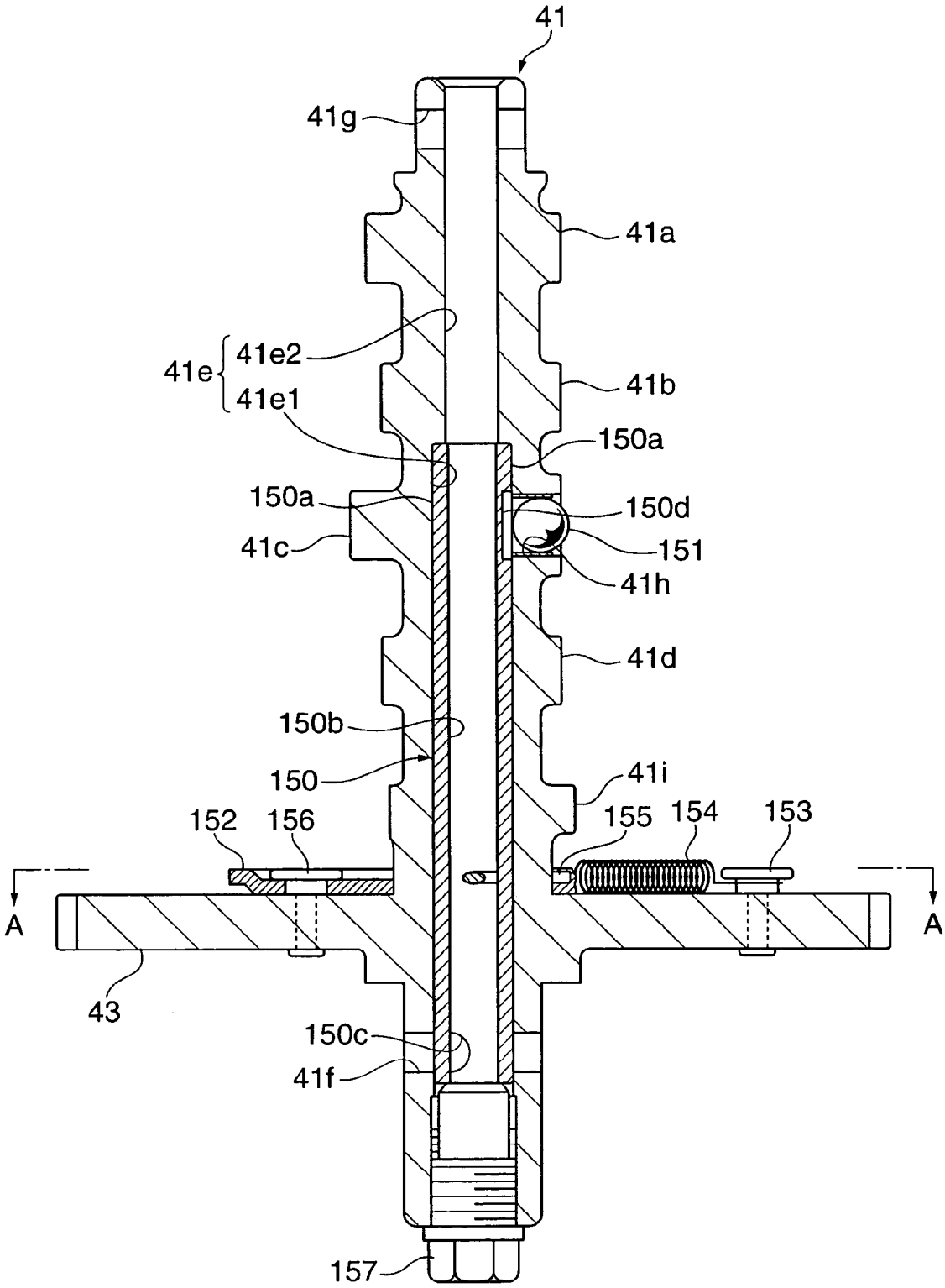
FIG. 9 is a longitudinal cross-sectional view of a camshaft appearing in FIG. 1.
Figure 10A:
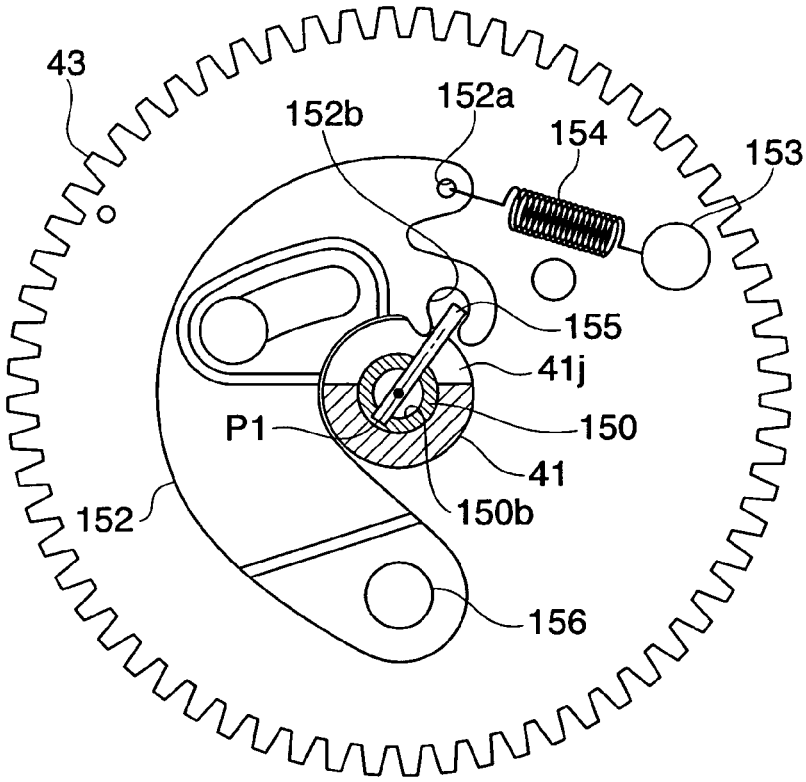
FIG. 10A is a cross-sectional view taken on line A—A in FIG. 9.
Figure 10B:
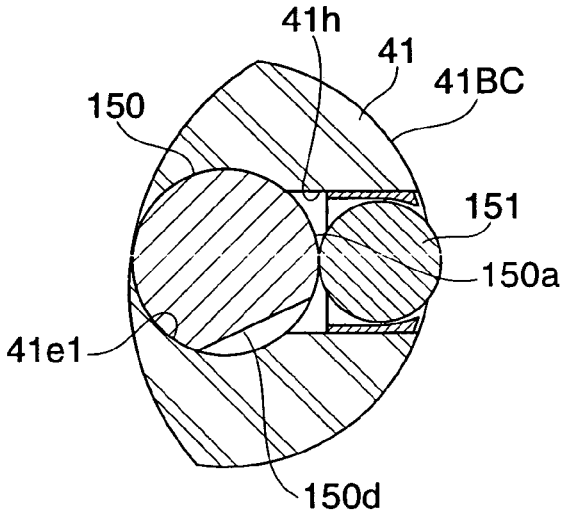
FIG. 10B is a cross-sectional view of a ball-holding part of the camshaft, which shows a steel ball in a projected state.
Figure 10C:
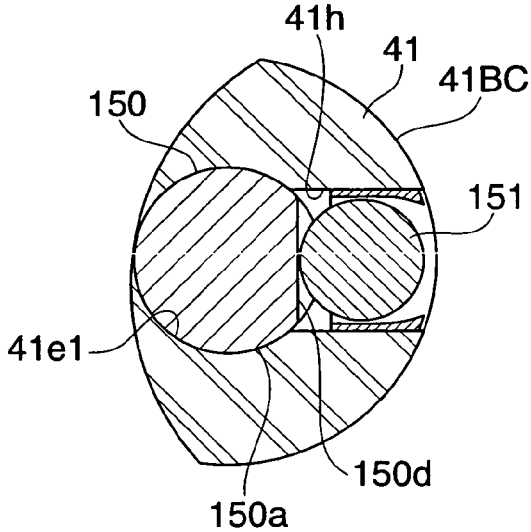
FIG. 10C is a cross-sectional view of the ball-holding part of the camshaft, which shows the steel ball in a retracted state.

FIG. 9 is a longitudinal cross-sectional view of the camshaft 41. FIG. 10A is a cross-sectional view taken on line A—A in FIG. 9. FIGS. 10B and 10C are cross-sectional views of a ball-holding part of the camshaft 41 which holds a steel ball. FIG. 10B shows a steel ball in a projected state, and FIG. 10C shows the steel ball in a retracted state.

As shown in FIG. 9, the camshaft 41 has a hollow structure and contains a hollow cylindrical decompression camshaft 150. More specifically, a substantially lower half part of an oil passage 41*e* within the above-described camshaft 41 forms an insertion hole 41*e*1 functioning as an oil passage as well, and an upper part of the oil passage 41*e* extending upward from the insertion hole 41*e*1 forms an upper oil passage 41*e*2 smaller in diameter than the insertion hole 41*e*1. The decompression camshaft 150 is fitted into the insertion hole 41*e*1 from below, and a bolt 157 is screwed into the lower end of the camshaft 41, whereby the decompression camshaft 150 is supported in the insertion hole 41*e*1 in a manner rotatable about a center point P1 (see FIG. 10A).

The decompression camshaft 150 also has a hollow structure, and has a decompression cam oil passage 150*b* coaxially formed therein. The decompression camshaft 150 has a lower end part thereof formed therein with an oil inlet hole 150*c* for communication between an oil introduction passage 41*f* of the camshaft 41 and the decompression cam oil passage 150*b*. As shown in FIGS. 9, 10B, and 10C, the decompression camshaft 150 has a cutout 150*d* formed therein at a location corresponding to the position of each of the RE cam 41*c* and the LE cam 41*d*. Further, the camshaft 41 is formed therein with a ball-holding part 41*h* holding a steel ball 151 at a location corresponding to the position of each of the RE cam 41*c* and the LE cam 41*d*. Although FIG. 9 shows only the ball projecting/retracting mechanism for the RE cam 41*c* (i.e. the cutout 150*d*, the ball-holding part 41*h*, and the steel ball 151 corresponding to the RE cam 41*c*), the ball projecting/retracting mechanism for the LE cam 41*d* is identical in structure to the ball projecting/retracting mechanism for the RE cam 41*c*, except for the position thereof in a direction of rotation about the center point P1. Therefore, hereafter, the structure of the ball projecting/retracting mechanism will be described basically by referring to the ball projecting/retracting mechanism for the RE cam 41*c*.

As shown in FIGS. 9 and 10A, on the top of the cam gear 43, there are provided fixing pins 153 and 156 projecting upward, and an arm 152 pivotally movable about the fixing pin 156 in the horizontal direction. Further, a return spring 154 is interposed between an engaging part 152*a* formed on the free end of the arm 152 and the fixing pin 153, and the arm 152 is constantly urged in the clockwise direction, as viewed in FIG. 10A, by the return spring 154. An engaging pin 155 is fixed to the decompression camshaft 150 at a location corresponding to the arm 152, and the tip of the engaging pin 155 is engaged in an engaging recess 152*b* of the arm 152. The camshaft 41 is formed with a gap part 41*j* for allowing pivotal motion of the engaging pin 155. The pivotal motion of the engaging pin 155 causes the decompression camshaft 150 to perform rotation relative to the camshaft 41 in unison with the engaging pin 155, independently of rotation of the camshaft 41.

The ball projecting/retracting mechanisms for the RE cam 41*c* and the LE cam 41*d*, the decompression camshaft 150, the arm 152, the fixing pins 153 and 156, the return spring 154, and the engaging pin 155 constitute a "decompression mechanism".

With this arrangement, the decompression mechanism operates as follows: At the start of the engine, when the starter grip 65 is pulled to cause cranking rotation of the crankshaft 35 by torque from the recoil starter 64, the rotational speed of the cam gear 43 is as low as that of the camshaft 41, and therefore not large a centrifugal force is applied to the arm 152. Therefore, the arm 152 still remains pressed against the camshaft 41 by the urging force of the return spring 154 as is the case where the camshaft 41 is stopped.

In this state, the cutout 150*d* of the decompression camshaft 150 is shifted from the ball-holding part 41*h* as shown in FIG. 10B, and therefore the steel ball 151 is brought into contact with an outer peripheral surface 150*a* of the decompression camshaft 150, whereby the steel ball 151 is projected radially outward. As a result, the steel ball 151 is held in the state projected radially outward from a cam base surface 41BC of the camshaft 41, and each of the pushrods 56 corresponding, respectively, to the LE cam 41*d* and RE cam 41*c* operates by an amount corresponding to the amount of projection of the steel ball 151 in accordance with the rotation of the camshaft 41, whereby the associated exhaust valve 54 is slightly opened via the associated locker arm 55. Thus, an increase in the compression pressure of the associated cylinder 34 is suppressed, and rotation resistance of the crankshaft 35 is reduced, which facilitates the start of the engine.

When the engine 2 starts, the rotational speed of the camshaft 41 becomes higher than a low rotational speed range, and an increased centrifugal force causes the arm 152 to perform counterclockwise rotation, as viewed in FIG. 10A, about the fixing pin 156 against the urging force of the return spring 154. Then, the engaging pin 155 rotates counterclockwise about the center point P1 to a predetermined position by engagement thereof with the engaging recess 152*b* of the arm 152, so that the decompression camshaft 150 also rotates in accordance with the rotation of the engaging pin 155, and this state is maintained until the rotational speed of the camshaft 41 returns to the low rotational speed range. In this state, as shown in FIG. 10C, the cutout 150*d* of the decompression camshaft 150 is substantially aligned with the ball-holding part 41*h*, so that the steel ball 151 is retracted toward the inner periphery of the decompression camshaft 150 to a position for contact with the cutout 150*d*. As a result, each of the exhaust valves 54 corresponding to the LE cam 41*d* and RE cam 41*c* operates according to the original cam profile of the associate cam.

Next, a description will be given of oil lubrication in the engine 2.

Figure 11:
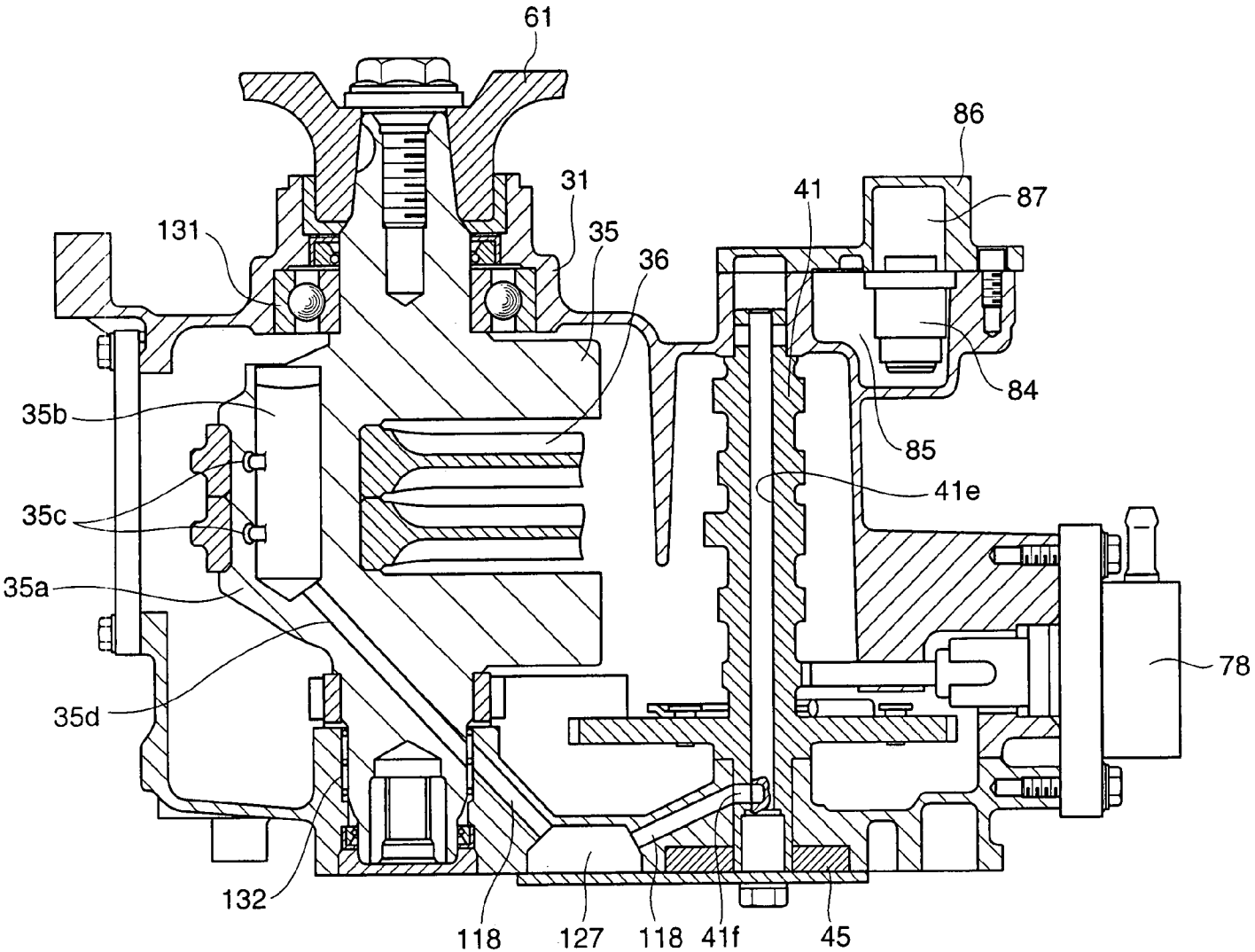
FIG. 11 is a cross-sectional view of the engine, which schematically shows a lubricating mechanism provided in the engine in FIG. 1.
Figure 12:
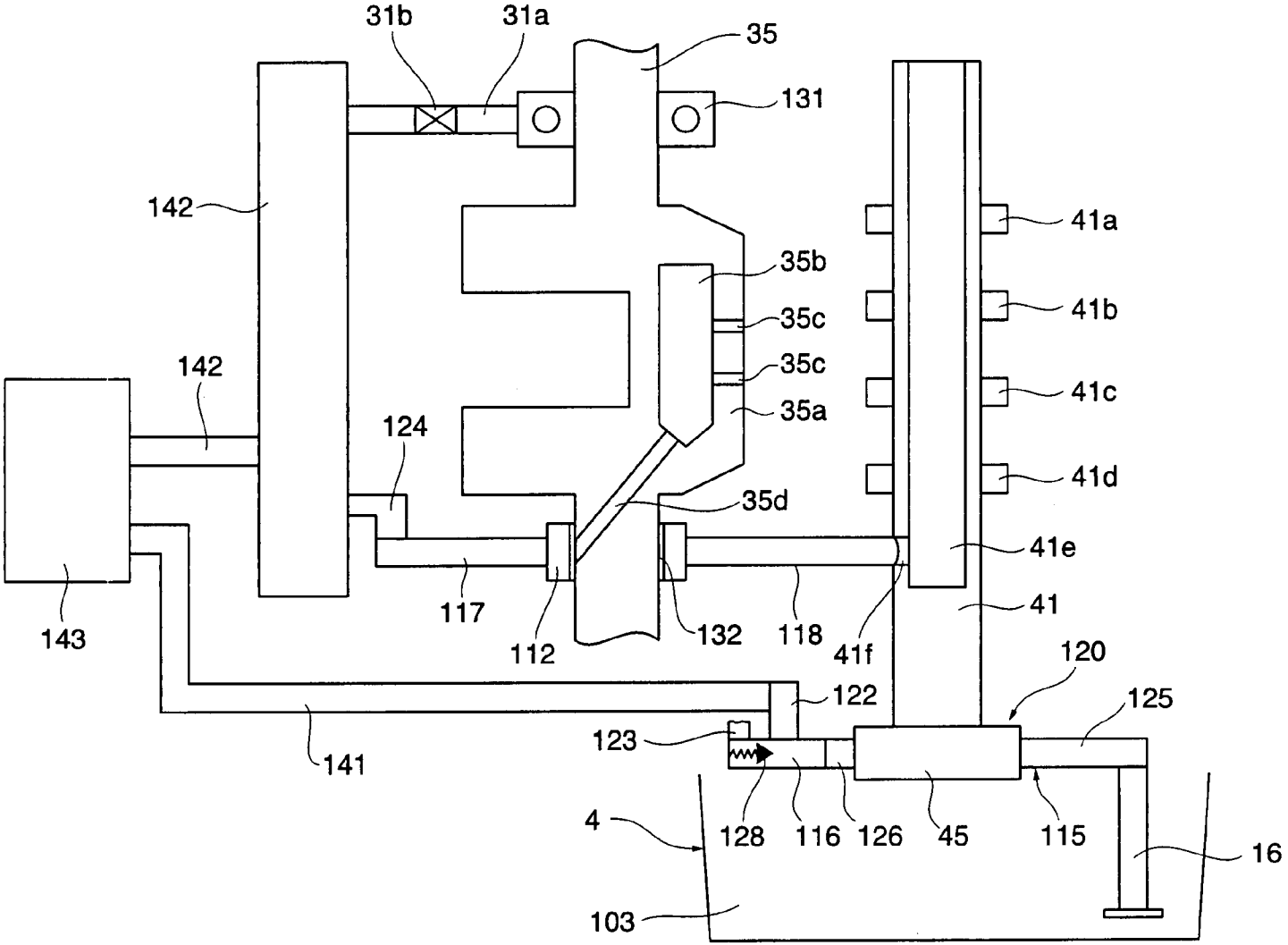
FIG. 12 is a schematic view schematically showing the arrangement of the lubricating mechanism.

FIG. 11 is a cross-sectional view of the engine 2, schematically showing a lubricating mechanism provided in the engine 2 including the lubrication structure 120, and FIG. 12 is a schematic view schematically showing the arrangement of the lubricating mechanism.

As shown in FIGS. 11 and 12, in the engine 2, the upper end of the crankshaft 35 is rotatably supported by an upper part of the cylinder block 31 via a ball bearing 131, and the lower end thereof is rotatably supported in the crankshaft hole 112 of the crankcase 3 via a metal bearing 132. Further, the crankshaft 35 has a generally hollow cylindrical oil reservoir 35*b* coaxially formed within a crank pin 35*a* to which the connecting rods 36 are rotatably mounted. The crank pin 35*a* has two connecting rod oil holes 35*c* formed at respective locations corresponding to sliding surfaces of the respective connecting rods 36, for supplying oil to the sliding surfaces of the respective connecting rods 36. The connecting rod oil holes 35*c* open in a sliding surface of the crank pin 35*a* facing the sliding surfaces of the connecting rods 36 and the oil reservoir 35*b*.

Further formed in the crankshaft 35 is a crankshaft oil passage 35*d* having one end thereof opening in a mounting part thereof on which the metal bearing 132 is mounted, and the other end opening into the oil reservoir 35*b*.

The cylinder block 31 is formed therein with an oil passage 31*a* having one end thereof opening into the main gallery 142 and the other end opening in a mounting part thereof on which the ball bearing 131 is mounted. The oil passage 31*a* has a venturi 31*b* provided therein so as to adjust the passage area of the oil passage 31*a*.

The oil passage 41*e* is coaxially formed in the camshaft 41, and opens in the upper end of the camshaft 41. Further, the camshaft 41 is formed therein with the oil introduction passage 41*f* having one end thereof opening in the sliding surface of the camshaft hole 114*a* and the other end opening into the oil passage 41*e* (see also FIG. 9).

As shown in FIGS. 11 and 12, oil pumped up from the oil reservoir 103 of the oil pan 4 through the oil strainer 16 by the operation of the oil pump 45 is supplied to the straight oil passage 116 via the first oil passage 125 of the curved oil passage 115, the oil pump chamber 114, and the second oil passage 126 of the curved oil passage 115. Then, the oil is supplied from the straight oil passage 116 to the oil filter 143 via the oil filter communication hole 122 and the oil filter passage 141. When the pressure within the second oil passage 126 exceeds a predetermined value, the relief valve 128 opens, and the oil is supplied into the oil filter communication hole 122 and the oil pan communication hole 123 so that a part of the oil is returned to the oil pan 4.

Then, the oil supplied to the oil filter 143 is filtered by the oil filter 143, and then supplied into the main gallery 142. A part of the oil supplied into the main gallery 142 is supplied to the first in-crankcase oil passage 117 via the main gallery communication hole 124 of the crankcase 3 and then enters the crankshaft hole 112. Further, another part of the oil supplied into the main gallery 142 is supplied to the ball bearing 131 via the oil passage 31*a* to lubricate the ball bearing 131. The amount of oil to be supplied to the ball bearing 131 is adjusted by the venturi 31*b*.

The part of the oil supplied through the first in-crankcase oil passage 117 to the crankshaft hole 112 lubricates the, metal bearing 132 and a part of the oil then flows into the crankshaft oil passage 35*d* via a hole, not shown, formed in the metal bearing 132 to be supplied to the oil reservoir 35*b*. The oil supplied to the oil reservoir 35*b* flows out through the connecting rod oil holes 35*c* to lubricate the sliding surfaces of the connecting rods 36. Further, another part of the oil flowing into the crankshaft hole 112 enters the second in-crankcase oil passage 118 to be supplied into the camshaft hole 114*a*.

The part of the oil supplied into the camshaft hole 114*a* through the second in-crankcase oil passage 118 lubricates the surface of the camshaft hole 114*a* on which the camshaft 41 slides, and another part of the oil flows into the oil introduction passage 41*f* to be supplied to the oil passage 41*e*. More specifically, as shown in FIG. 9, the oil flows from the oil introduction passage 41*f* into the decompression cam oil passage 150*b* via the oil inlet hole 150*c*, and then flows to the upper oil passage 41*e*2. At this time, a part of the oil flows from the upper end of the decompression camshaft 150 to a clearance between the outer peripheral surface 150*a* and the insertion hole 41*e*1 to lubricate sliding surfaces of the decompression camshaft 150 and the camshaft 41, as well as the ball projecting/retracting mechanisms for the RE cam 41*c* and the LE cam 41*d*.

Further, the oil having flowed into the upper oil passage 41*e*2 overflows the upper end of the camshaft 41 to lubricate the cams 41*a* to 41*i* as well as the cam gear 43 and various component parts, including the arm 152, provided above the cam gear 43, which constitute the decompression mechanism. Thus, the camshaft 41 and the decompression mechanism are lubricated by the compact lubricating structure.

Further, as described before, the oil in the oil reservoir 103 of the oil pan 4 is circulated within the engine 2 to lubricate various parts of the engine 2, followed by being returned to the oil reservoir 103.

According to the present embodiment, the two-cylinder V-type OHV engine 2 is configured such that the single camshaft 41 is driven by the crankshaft 35 via the idle gear 44, whereby it is possible to save space in the transverse direction of the engine 2. More specifically, although the engine 2, which is the V-type, tends to have a large engine width compared with an in-line type engine, the configuration in which the camshaft 41 is driven via the idle gear 44 makes it possible to set the respective diameters of the crank gear 42 and the cam gear 43 to be smaller than in the case where the camshaft 41 is directly driven by the crankshaft 35, which enables suppression of an increase in the engine width. In addition, the weight of the camshaft 41 itself can be reduced.

Further, in the vertically installed engine 2 in which the two cylinders 34L and 34R are vertically offset from each other with the cylinder 34R disposed at the higher location, the idle gear 44 is offset toward the starboard side where the cylinder 34R is provided, whereby the space created below the cylinder 34R can be effectively utilized to save the vertical space in the engine. Furthermore, since the camshaft 41 is formed with the cams arranged in the order of 41*a*, 41*b*, 41*c*, 41*d*, and 41*i*, from above, the vertical space in the engine 2 can be saved.

Further, since the fuel pump 78 is disposed between the cylinder banks LB and RB together with the camshaft 41 such that the fuel pump 78 can be driven by the camshaft 41 close thereto, the space within the V-bank can be utilized to install the fuel pump 78, which contributes to space saving.

Moreover, the decompression camshaft 150 as a part of the decompression mechanism is inserted in the insertion hole 41*e*1 of the camshaft 41, and oil is introduced into the decompression cam oil passage 150*b* within the decompression camshaft 150 and the upper oil passage 41*e*2 in the camshaft 41, so that in the structure where the camshaft 41 contains the component parts of the decompression mechanism, the camshaft 41 and the decompression mechanism can be lubricated by the compact lubricating structure, which makes it possible to ensure the durability (abrasion resistance) of both the camshaft 41 and the decompression mechanism.

What is claimed is:

1. A two-cylinder V-type OHV engine (2) vertically installed for an outboard motor, comprising:

a first cylinder bank (RB) having a first cylinder (34R);

a second cylinder bank (LB) having a second cylinder (34L);

a single camshaft (41) disposed in a vertical direction of the engine and having a lower end;

an idle gear (44);

a crankshaft (35);

an engine cover (8) covering the engine;

an oil pump (45) disposed at the lower end of said single camshaft; and an oil filter (143) connected to said oil pump via at least one oil passage (126, 116, 122, 141), wherein said first cylinder bank (RB) and said second cylinder bank (LB) are arranged to form a V-shape, wherein said first and second cylinders are located on respective right and left sides of the engine and vertically offset from each other such that one of said first and second cylinders is disposed at a higher location than the other of said first and second cylinders, wherein said crankshaft (35), said single camshaft (44), and said idle gear (44) are disposed such that said crankshaft (35) drives said single camshaft (41) via said idle gear (44), wherein said idle gear is offset toward one of the right and left sides of the engine where the one of said first and second cylinders, which is disposed at the higher location, is located, wherein one of said first and second cylinder banks having one of said first and second cylinders corresponding to said offset idle gear has a plane, on which said oil filter is mounted, and wherein said plane is parallel with an axis of the one of said first and second cylinders corresponding to said offset idle gear such that the plane faces forward of the outboard motor.

2. A two-cylinder V-type OHV engine as claimed in claim 1, wherein said camshaft has an intake cam (41*a*) for said first cylinder, an intake cam (41*b*) for said second cylinder, an exhaust cam (41*c*) for said first cylinder, an exhaust cam (41*d*) for said second cylinder, and a fuel pump-driving cam (41*i*) sequentially formed in an order mentioned along an axis thereof.

3. A two-cylinder V-type OHV engine as claimed in claim 1, comprising a fuel pump (78) disposed between said first and second cylinder banks together with said camshaft, such that said fuel pump is driven by said camshaft.

4. A two-cylinder V-type OHV engine as claimed in claim 1, wherein said camshaft has an oil passage (41*e*) formed therein along an axis thereof;

the engine comprises a hollow member (150) inserted in the oil passage, said hollow member having a hollow part (150*b*) and forming a part of a decompression mechanism; and lubricating oil is introduced into said hollow part of said hollow member and the oil passage of said camshaft.

5. A two-cylinder V-type OHV engine as claimed in claim 1, wherein said at least one oil passage, which supplies lubricating oil from said oil pump disposed at the lower end of said single camshaft to said oil filter, comprises a curved oil passage (126) and a straight oil passage (116).

6. A two-cylinder V-type OHV engine as claimed in claim 5, wherein said curved oil passage is formed by an oil pump chamber (114) accommodating said oil pump, a curved oil groove which has one end thereof connecting to said oil pump chamber and other end thereof connecting to said straight oil passage and a cover member (119) air-tightly covering said oil pump chamber and said curved oil groove.

* * * * *